US006061937A

United States Patent [19]

Meng

[11] Patent Number: 6,061,937

[45] Date of Patent: May 16, 2000

[54] CRYSTAL BALL WATER SEALING STRUCTURE

[76] Inventor: Sally Meng, 8F, No. 22, Lane 81, Wen-Hu Rd., Nei-Hu Dist., Taipei City, Taiwan

[21] Appl. No.: 09/056,189

[22] Filed: Apr. 8, 1998

[51] Int. Cl.[7] ..... G09F 19/00

[52] U.S. Cl. ..... 40/409; 40/410; 446/267

[58] Field of Search ..... 40/406, 409, 410, 40/411, 414; 446/267; 428/13

[56] References Cited

U.S. PATENT DOCUMENTS

| | | | |
|---|---|---|---|
| 4,771,902 | 9/1988 | Teng | 40/410 X |
| 5,088,218 | 2/1992 | Liu | 40/411 |
| 5,090,144 | 2/1992 | Liu | 40/410 |
| 5,416,995 | 5/1995 | Teng | 40/409 X |
| 5,675,921 | 10/1997 | Lin | 40/409 |

*Primary Examiner*—Brian K. Green
*Attorney, Agent, or Firm*—Ladas & Parry

[57] ABSTRACT

A crystal ball water sealing structure includes a hollow, transparent, spherical water container having a neck and an inside annular groove within the neck, a rubber stopper plugged into the neck of the spherical water container to seal the spherical water container in a water tight condition, the rubber stopper having an outward flange forced into engagement with the inside annular groove in the neck of the spherical water container and an inside annular groove, and a spring element mounted in the inside annular groove in the rubber stopper, the spring element imparting an outward pressure to the rubber stopper, causing the rubber stopper to expand radially and to engage with the periphery of the neck of the spherical water container so as to prevent a water leakage.

3 Claims, 3 Drawing Sheets

CRYSTAL BALL WATER SEALING STRUCTURE

BACKGROUND OF THE INVENTION

The present invention relates to a crystal ball ornament, and more particularly to the water sealing structure of the crystal ball for the crystal ball ornament.

There is known a crystal ball ornament which is comprised of a crystal ball and a holder base. The holder base comprises a receptacle, and a design raised from the receptacle. The crystal ball is mounted in the receptacle on the holder base. The crystal ball is comprised of a transparent, spherical water container which holds a liquid, and a rubber stopper fastened to the neck of the spherical water container by a glue to seal the liquid. When light is projected onto the crystal ball, it is refracted by the liquid in the crystal ball in different directions, Further, when viewing an object put behind the crystal ball, the image of the object is magnified by the crystal ball. However, because the spherical water container and the rubber stopper have different coefficient of heat expansion, a gap tends to occur between the neck of the spherical water container and the rubber stopper when the ambient temperature changes significantly, thereby causing a water leakage.

SUMMARY OF THE INVENTION

The present invention has been accomplished to provide a crystal ball water sealing structure which eliminates the aforesaid problem. According to one aspect of the present invention, the crystal ball water sealing structure comprises a hollow, transparent, spherical water container having a neck, a rubber stopper plugged into the neck of the spherical water container to seal the spherical water container in a water tight condition, and a spring element mounted in the inside annular groove in the rubber stopper, the spring element imparting an outward pressure to the rubber stopper, causing the rubber stopper to expand radially and to engage with the periphery of the neck of the spherical water container so as to prevent a water leakage. According to another aspect of the present invention, the spherical water container has an inside annular groove within its neck, and the rubber stopper has an outward flange forced into engagement with the inside annular groove in the neck of the spherical water container.

DETAILED DESCRIPTION OF THE PREFERRED EMBODIMENT

Figure 1:
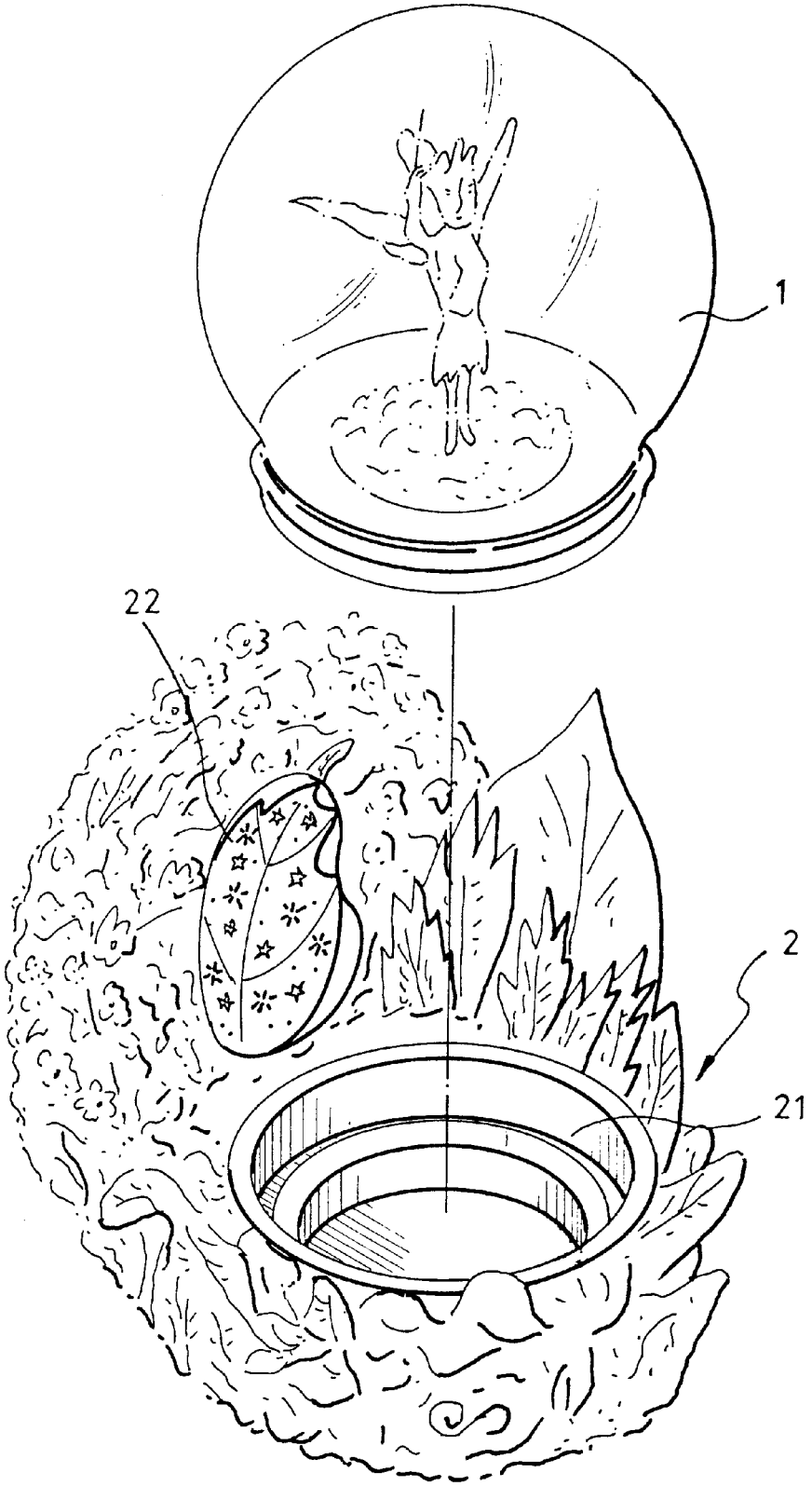
FIG. 1 is an exploded view of a crystal ball ornament according to the present invention.

Referring to FIG. 1, a holder base 2 is provided to hold a crystal ball 1. The holder base 2 comprises a receptacle 21, and a porous ornament 22 raised around the periphery of the receptacle 21. The porous ornament 22 can be a sculpture or any of a variety of designs. The crystal ball 1 is mounted in the receptacle 21. The porous ornament 22 has an upright part risen behind the crystal ball 1. When light from a light source (not show) is projected onto the back side of the porous ornament 22, light rays pass through the tiny holes on the porous ornament 22 to the crystal ball 1, and are refracted by the crystal ball 1 in different directions, thereby causing a fantastic visual effect to be produced.

Figure 2:
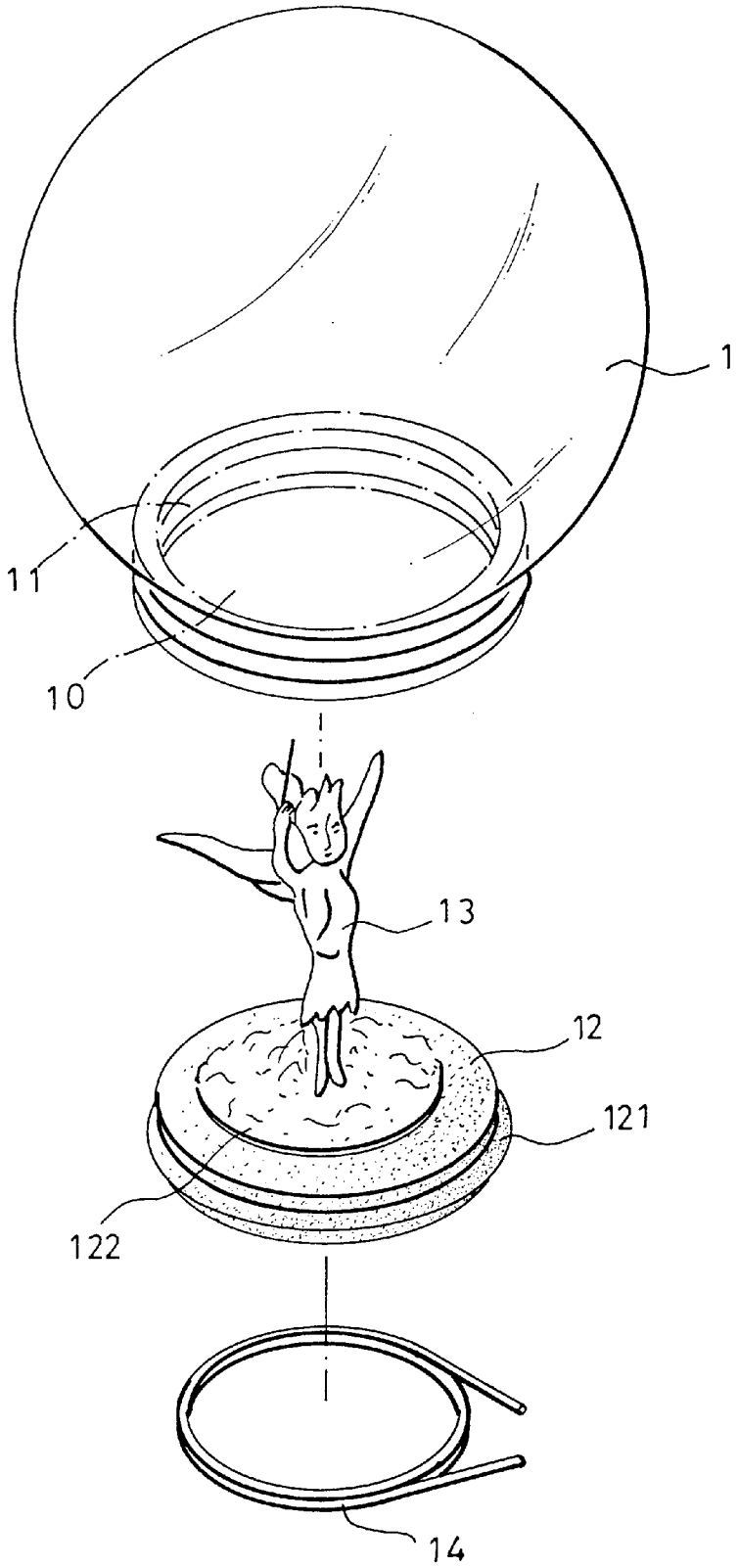
FIG. 2 is an exploded view of the crystal ball for the crystal ball ornament shown in FIG. 1.
Figure 3:
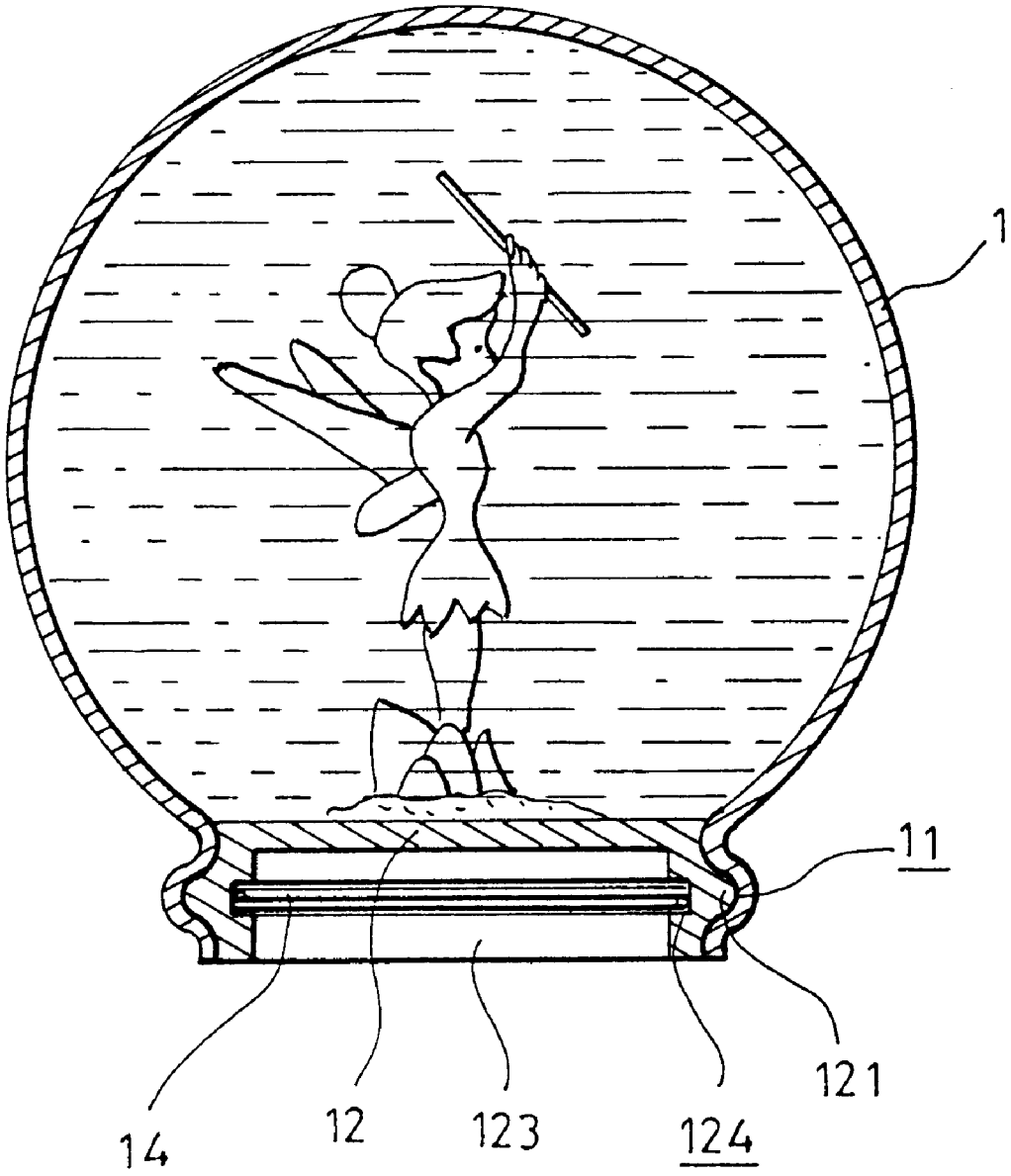
FIG. 3 is a sectional assembly view of the crystal ball according to the present invention.

Referring to FIGS. 2 and 3, the crystal ball 1 is comprised of a transparent, spherical water container 10, a rubber stopper 12, and a spring element 14. The spherical water container 10 has an inside annular groove 11 within the neck thereof. The rubber stopper 12 is plugged into the neck of the spherical water container 10 of the crystal ball 1 to seal the spherical water container 10 into a water tight status. The rubber stopper 12 is a hollow, circular rubber block 123 comprising an outward flange 121 raised around the periphery which is forced into engagement with the inside annular groove 11 in the neck of the spherical water container 10, a platform 122 raised from the front side thereof, an ornament for example a doll 13 mounted on the platform 122, and an inside annular groove 124 around the inside wall thereof. When a liquid is filled in the spherical water container 10, the rubber stopper 12 is plugged into the neck of the spherical water container 10 to dip the ornament 13 in the liquid in the spherical water container 10 and to force the outward flange 121 into engagement with the inside annular groove 11, and then the spring element 14 is fastened to the inside annular groove 124 inside the rubber stopper 12. The spring element 14 imparts an outward pressure to the rubber stopper 12, causing the rubber stopper 12 to be radially expanded, and therefore the engagement between the outward flange 121 of the rubber stopper 12 and the inside annular groove 11 in the neck of the spherical water container 10 is water-tightly secured.

What the invention claimed is:

1. A crystal ball water sealing structure comprising:

a transparent, spherical water container for holding a liquid within the spherical water container, said spherical water container having a neck with an inner periphery;

a rubber stopper plugged into the neck of said spherical water container to seal said liquid in said spherical water container without utilizing glue for adhesion, said rubber stopper holding an ornament inside said spherical water container; and a spring mounted in said rubber stopper, the spring being a separate member from the rubber stopper, said spring imparting an outward pressure onto said rubber stopper, causing said rubber stopper to expand radially and to engage with the inner periphery of the neck of said spherical water container.

2. The crystal ball water sealing structure of claim 1, wherein said spherical water container has an insider annular groove within said neck, and said rubber stopper has an outsider flange raised around the inner periphery and forced into engagement with the inside annular groove in the neck of said spherical water container.

3. The crystal ball water sealing structure of claim 1, wherein said rubber stopper comprises an inside annular groove in an open chamber at an outer side thereof which receives said spring.

* * * * *